United States Patent [19]

Beaudoin

[11] Patent Number: 4,685,171

[45] Date of Patent: Aug. 11, 1987

[54] GUIDE FOR A DRIVEN ENDLESS BELT

[75] Inventor: Laurent Beaudoin, Welland, Canada

[73] Assignee: Iona Appliances Inc., Welland, Canada

[21] Appl. No.: 860,912

[22] Filed: May 8, 1986

[51] Int. Cl.[4] ..... A47L 9/32

[52] U.S. Cl. ..... 15/391; 15/332

[58] Field of Search ..... 15/332, 391, 389–390; 474/144

[56] References Cited

U.S. PATENT DOCUMENTS

| | | | |
|---|---|---|---|
| 2,322,223 | 6/1943 | Coss | 15/332 |
| 2,538,464 | 1/1951 | MacFarland | 15/390 |
| 2,616,115 | 11/1952 | Dayton | 15/332 |
| 2,954,577 | 10/1960 | Beach | 15/332 |
| 3,049,744 | 8/1962 | MacFarland | 15/324 |

FOREIGN PATENT DOCUMENTS 376639 9/1938 Canada .

*Primary Examiner*—Chris K. Moore

*Attorney, Agent, or Firm*—Weldon F. Green

[57] ABSTRACT

The combination with apparatus, wherein an endless tensioned belt is twisted to form a first loop engaging the unsupported end of a motor shaft and a second loop engaging a rotary element so as to drive same, of a removable barrier to the advancement or creep of the endless tensioned belt towards the unsupported end of the motor shaft when the rotary element has reverse rotation imparted to it, the removable barrier including an anchoring portion securable to the housing and having a portion projecting therefrom into the housing to present a bearing surface to at least one reach of the tensioned belt in the path of advancement or creep of same.

4 Claims, 6 Drawing Figures

FIG. 1a
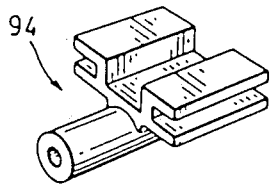
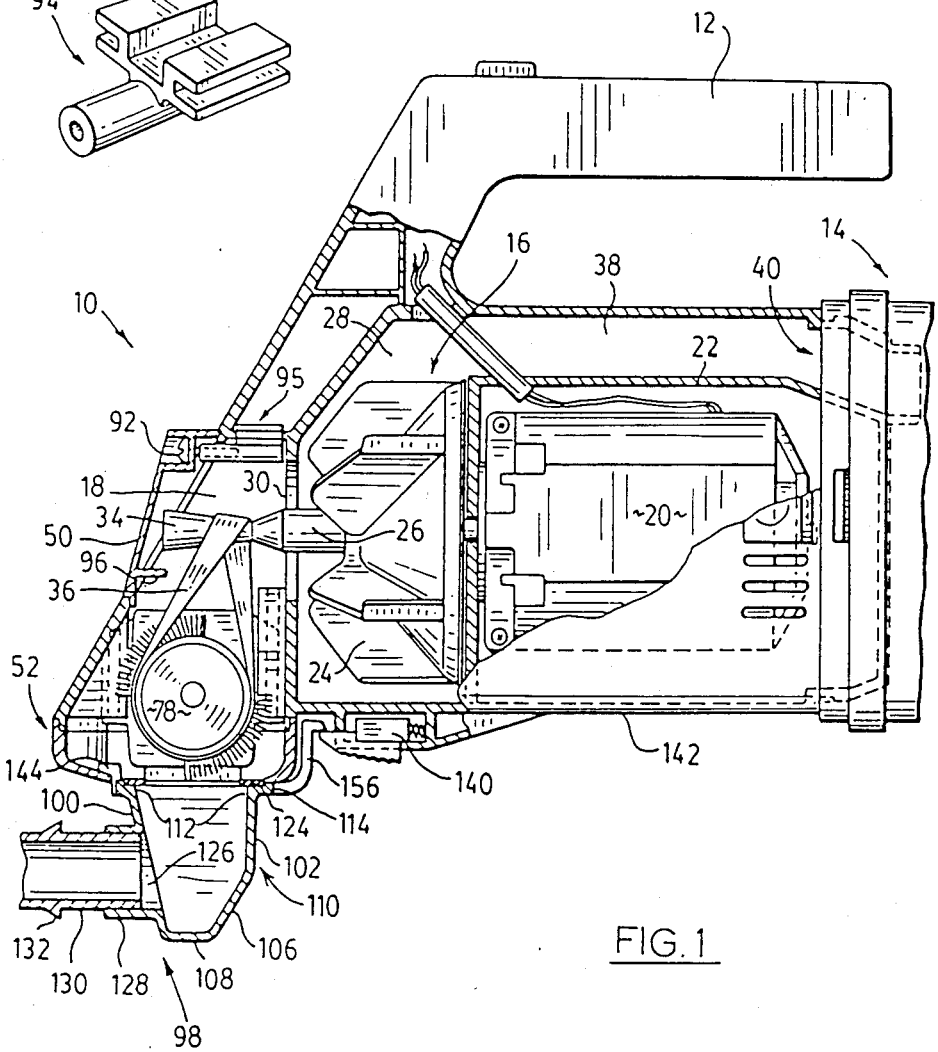
FIG. 1

FIG. 4
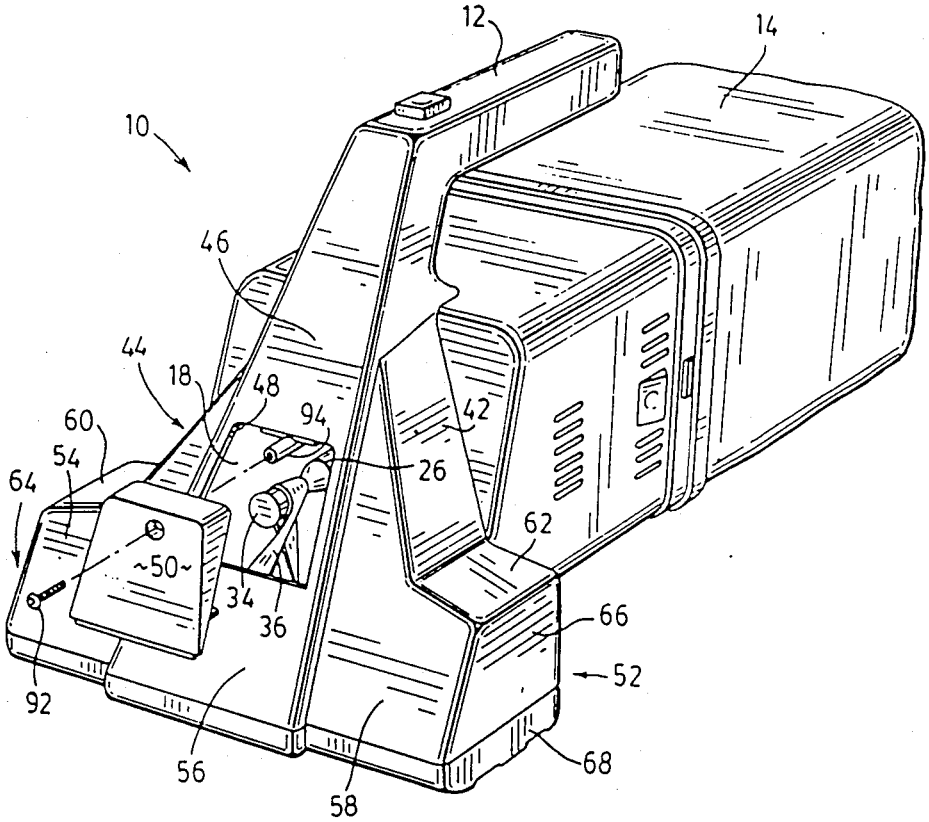
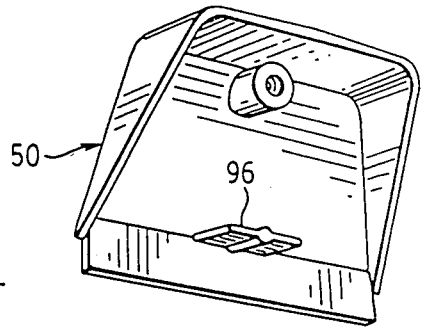
FIG. 5

GUIDE FOR A DRIVEN ENDLESS BELT

FIELD OF INVENTION

This invention relates to improvements in suction or vacuum apparatus of the type wherein a rotary brush or beater is mounted within the nozzle portion of the take-up passageway and is driven by a tensioned endless belt which is twisted to form a first loop to frictionally engage the rotary brush or beater circumferentially centrally thereof and a second loop which frictionally engages the unsupported end portion of a motor driven shaft which extends into the take-up passageway.

More particularly, this invention relates to an improved structure for ensuring that the tensioned endless belt is maintained in driving relationship between the rotary brush or beater and the motor driven shaft despite reversal of the rotary brush or beater while cleaning same while the apparatus is switched off or propelling same over a supporting surface, as well as providing for ready access to the take-up passageway for replacing the endless belt when it fails or for inspection or other repairs.

BACKGROUND OF THE INVENTION

The rotary brush or beater mounted for rotation in the nozzle portion of the take-up passageway of the suction or vacuum apparatus of the type mentioned is typically driven by a tensioned endless belt looped and offset at 90° more or less by twisting so as to frictionally engage the brush or beater located circumferentially centrally thereof on the one hand, and the unsupported end of the motor driven shaft on the other hand, which shaft also drives the suction fan or impeller of the apparatus.

An access opening is provided in the wall of the housing surrounding and defining the take-up passageway, opposed to and in general axial alignment with the unsupported end of the driven shaft so that the requisite loop of the endless belt can be applied over same through such access opening or removed therefrom and withdrawn as the case may be.

Such access opening is provided with a closure member releasably secured to the surrounding housing so as to complete the housing defining the internal take-up passageway.

According to Dayton U.S. Pat. No. 2,616,115, with such an arrangement, when the brush or beater is forced to rotate through manipulation in a direction the reverse of its normal direction of rotation, the belt portion surrounding and bearing against the unsupported end portion of the motor driven shaft tends to creep axially outward along such portion and away from the motor housing until it becomes completely disengaged.

This may occur when the operator removes strands of material or fibres which have become wound around the brush or beater or when the brush or beater is supported upon a surface and displaced or propelled thereover to rotate same in a direction opposed to its normal direction which imparts reverse rotation to the motor driven shaft and consequent belt disengagement.

Proposals have been put forward to prevent such belt from riding off the motor driven shaft extremity.

One such embodiment is presented by MacFarland U.S. Pat. No. 3,049,744 which includes the provision of circumferentially extending flanges located at the extremity of the fan motor shaft and disposed perpendicularly to the shaft which will prevent advancement of the belt toward the unsupported shaft extremity.

An alternative resides in so contouring the shaft extremity as to provide a substantial enlargement and so effectively constrain the belt against dislodgement, as illustrated in Frame Canadian Pat. No. 376,639.

While the proposals of the prior art may prevent such belt from disengaging from or riding off the unsupported end of the driven shaft of the motor, by adopting same removal of the belt from the shaft or replacement is rendered very much more difficult.

Removal or replacement of such belt in the circumstances outlined will require the application of considerable force to stretch the belt so as to clear the obstruction, thereby increasing the possibility of potential injury to the fingers or the hand, and, as well, unnecessarily creating an inconvenience for the user and undue extension of the belt itself leading to deterioration.

Other patents, for example Erbor U.S. Pat. No. 3,437,424 and Brace U.S. Pat. No. 2,719,317, disclose belt lifting apparatus for disengaging the belt from the motor shaft and allowing for insertion and registration of a hose attachment directly within the fan chamber intake.

OBJECTS OF THE INVENTION

It is a principal object of this invention therefore to simplify the manner in which the tensioned endless belt of a suction or vacuum apparatus of the type under consideration can be prevented from riding off the driven unsupported end of the motor shaft when the rotary brush or beater is displaced through manipulation or otherwise to rotate in a direction opposite to its normal direction of rotation, yet allow for ready removal or replacement of the belt whenever required.

More particularly, it is an important object of this invention to provide such constraint against advancement of the tensioned endless belt towards the unsupported end of the driven shaft in the form of simplified structure which can be readily incorporated into existing suction or vacuum apparatus at relatively low cost.

It is also an important object to provide such structure in a form that will not appreciably affect the operating characteristics of any apparatus or cause undue wear of the tensioned belt in the circumstances.

FEATURES OF THE INVENTION

The principal feature of this invention resides in providing a removable barrier to the displacement imparted to the tensioned endless belt of such or similar apparatus in the form of a bearing surface formation presented to at least one reach of the tensioned endless belt in the region of the unsupported end portion of the driven shaft and adjacent thereto, such bearing surface formation including an anchoring portion for releasably securing same to the surrounding housing and a portion projecting therefrom, said latter projecting portion including a bearing surface at the end thereof remote from said anchoring portion for contact with the endless belt in the aforementioned region should the belt creep from the position establishing the operating relationship of belt to driven shaft towards the unsupported end.

More particularly, it is a feature of this invention to utilize the closure member for the housing access opening to carry or serve as the anchoring portion of the bearing surface formation, and by so securing or anchoring the projecting portion on or to the inner surface thereof and by selecting its inward extent will ensure requisite presentation of the bearing surface to the selected reach of the tensioned belt each time the closure member is fully registered within the access opening to complete the surrounding housing.

Thus, it will be appreciated that upon removal or disengagement of the closure member to expose the housing access opening the projecting portion is simultaneously withdrawn providing for ready unobstructed access to the chamber or take-up passageway for removal or replacement of the belt or for inspection or other repairs.

Still another feature of this invention resides in providing the projecting portion in the form of an elongated flange that extends inwardly from the closure member or anchoring portion to present the bearing surface adjacent the unsupported end of the driven shaft and into the region of advancement of the tensioned belt should it be subjected to creep, with such in the region of the bearing surface extending generally at right angles to the direction of the tensioned belt and appreciably therebeyond so as to effectively bar or constrain at least one reach of the tensioned belt against further advancement upon contacting such bearing surface.

Thus, it will be understood that through presentation of such removable barrier to the advancement of the tensioned belt which takes the form of a flange formation in the preferred embodiment anchored to or carried by the removable closure member, simplicity and convenience are at once realized, and, as well, minimum obstruction of the passageway itself by such flange formation is achieved.

BRIEF DESCRIPTION OF THE DRAWINGS

These and other objects and features are to be found in the following description of the preferred embodiment of the invention to be read in conjucntion with the sheets of drawings in which:

FIG. 1 is a sectioned side view of portable suction or vacuum apparatus including a hose assembly according to the invention;

FIG. 1*a* is an enlarged perspective view of a socket element for use in conjunction with the apparatus of FIG. 1;

FIG. 4 is a perspective front view of the apparatus of FIG. 1 without the hose assembly according to the invention wherein the closure member has been exploded away in order to illustrate the relationship between the closure member and the front wall of the apparatus;

FIG. 5 is an enlarged perspective rear view of the closure member of FIG. 4.

DETAILED DESCRIPTION OF THE PREFERRED EMBODIMENT

Figure 3:
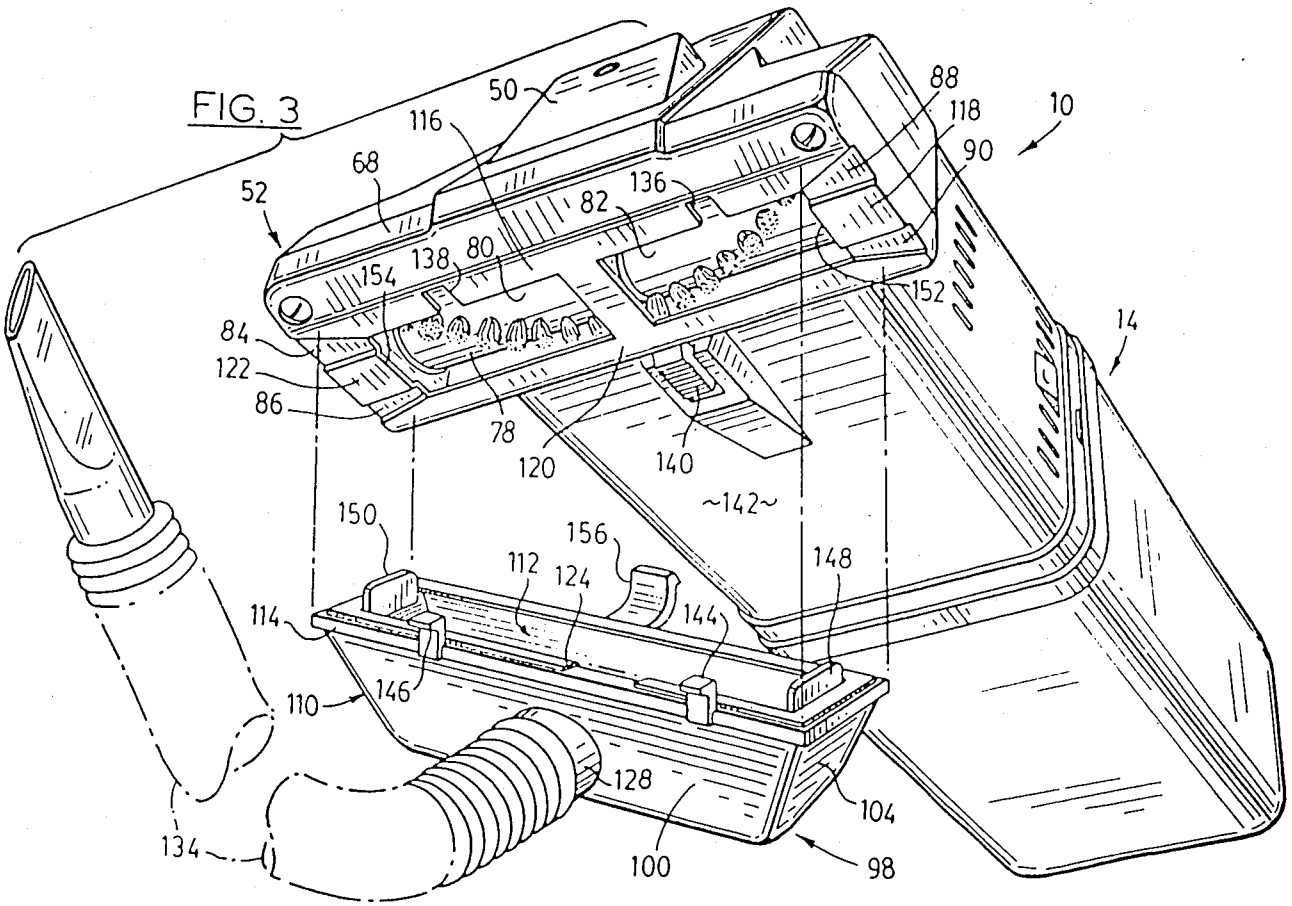
FIG. 3 is a perspective bottom view of the apparatus of FIG. 1 and of a hose assembly according to the invention and wherein a length of hose and associated accessory attachment are secured to the hose assembly.

According to the preferred embodiment of the invention, portable vacuum apparatus generally designated at 10 in FIG. 1 includes a handle 12, a filter and dirt collection unit 14, only partially shown in FIG. 1 but more fully illustrated in FIG. 3, a fan or blower unit 16 and a take-up passageway 18.

The fan or blower unit 16 includes a motor 20 mounted within motor housing 22, and impellor 24 driven by motor shaft 26 within impellor chamber 28.

Motor shaft 26 extends forwardly of the motor housing 22 through orifice 30 of impellor chamber 28 and into the take up passageway 18. The unsupported end 34 of motor shaft 26 is suitably tapered so as to form a pulley groove for a endless tensioned belt 36 as described in greater detail below.

In operation, motor 20 drives impellor 24 which draws air from take up passageway 18 through orifice 30 and into impellor chamber 28. The air is then directed through evacuation channel 38 and outlet 40 to the filter and dirt collection unit 14.

The take up passageway 18 is defined by a surrounding housing, best illustrated in FIG. 4, which includes forwardly and downwardly diverging side walls 42 and 44 and a forwardly and downwardly extending forward wall 46. Forward wall 46 includes an access opening 48 and a closure member 50 as described in greater detail below.

The housing surrounding and defining the take up passageway 18 further includes an enlarged base portion lowermost thereof, hereinafter referred to as the nozzle 52. Said nozzle is defined by forwardly inclined front wall portions 54, 56 and 58, generally laterally extending segments 60 and 62, substantially parallel side walls portions 64 and 66 and a base plate 68, best illustrated in FIG. 3.

Figure 2:
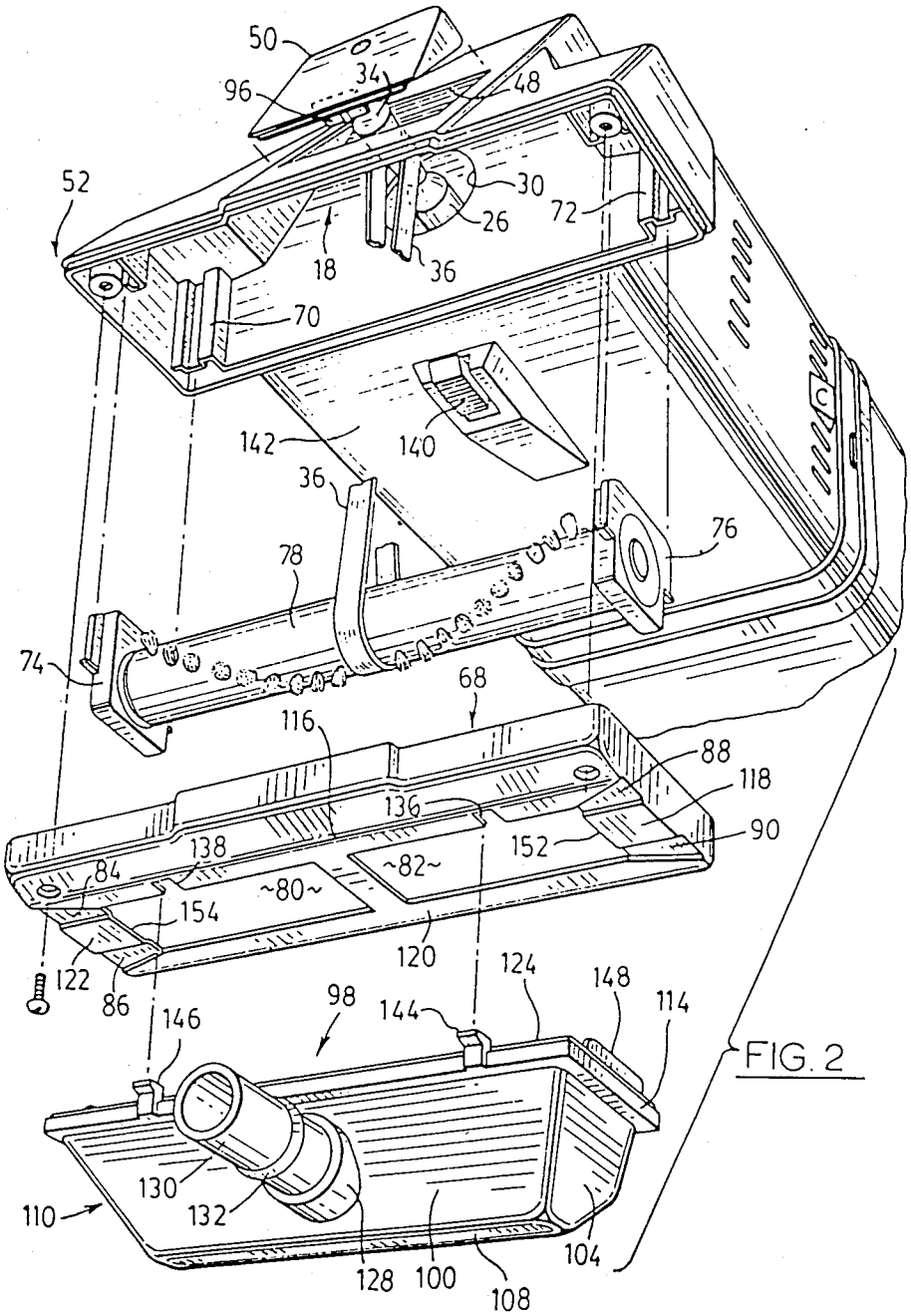
FIG. 2 is an exploded view of the nozzle, brush and brush mountings of the apparatus of FIG. 1 including a hose assembly according to the invention.

Referrng to FIG. 2, sockets 70 and 72 are provided in the nozzle 52 and are adapted to receive mountings 74, 76 for a rotary brush 78 to extend longitudinally within the nozzle.

Base plate 68 of nozzle 52 partially encloses the take up passageway 18, as best illustrated in FIG. 3, but includes inlet orifices 80, 82 through which rotary brush 78 partly projects so as to allow the rotary brush to come into contact with the surface to be cleaned. Base plate 68 also includes vents 84, 86, 88 and 90 at the longitudinal extremities thereof so as to enable the nozzle to effectively clean wall corners and other angled locations by providing a passageway for entraining air and dirt particles from such corners or angled locations when the corner of the cleaner nozzle 52 is seated therein.

Referring to FIG. 1, the rotary brush 78 is driven to rotate about its longitudinal axis by a suitably tensioned endless belt 36 offset by twisting to form a lower loop which frictionally engages rotary brush 78 centrally of the longitudinal axis thereof and generally at right angles thereto and an upper loop which engages the unsupported end 34 of the driven motor shaft 26 which extends into the take up passageway 18.

The access opening 48 is provided in the forward wall 46 of the housing which defines the take up passageway opposed to and in general alignment with the unsupported shaft end 34 and a closure member 50 adapted to register within access opening 48, best illustrated in FIGS. 2 and 3. The outer shape of closure member 50 may be chosen to complement the aesthetic presentation of the exterior of the take up passageway housing and to provide a convenient grip for removal of the closure member.

The closure member 50 may be detachably secured over access opening 48 by means of a screw 92. A suitable socket element 94 illustrated in FIG. 1*a* is secured in the upper end of the take up passageway 18 as at 95, as best illustrated in FIG. 1, and is adapted to receive screw 92.

A substantially horizontal inwardly projecting flange 96 is anchored upon closure member 50 and is adapted to nearly abut the downwardly extending reach of the endless tensioned belt 36 when closure member 50 is secured over access opening 48 by screw 92 as best illustrated in FIG. 1. Flange 96 acts as a bearing surface formation barring advancement of the endless tensioned belt along a path towards the unsupported end 34 of the driven motor shaft and the belt 36 is therefore effectively prevented from becoming disengaged from the motor shaft 26 when the rotary brush is inadvertently forced into rotation in a direction opposite to that of its normal operational rotation. Removal of closure member 50 removes flange 96 from its nearly abutting relationship with the edge of tensioned endless belt 36 so as to allow removal, inspection and repair of belt 36 while simultaneously allowing access thereto through access opening 48.

Referring to FIGS. 1, 2 and 3, a hose assembly generally designated 98 includes generally upstanding front 100, back 102, side 104 wall portions, an inclined back wall portion 106 and a base portion 108 defining a narrow and elongated trough-like structure 110. The upper edges of the said wall portions define an opening 112 into the trough-like structure, said upper edges of said wall portions terminating in an outwardly projecting edge formation 114 surrounding said opening. The narrow and elongated trough-like structure 110 is of such an extent and configuration that when opening 112 is presented in overlying registration with the base plate 68 of the nozzle 52 the edge formation bears against the surface segments 116, 118, 120 and 122 of the base plate 68 surrounding the generally elongated inlet orifices 80 and 82 and the trough-like structure encloses the rotary brush 78. Edge formation 114 includes a peripheral strip of compressible gasket means 124 carried thereon so as to provide an airtight seal when the trough-like structure 110 and the base plate 68 are brought into overlying registration.

The elongated front wall portion 100 of the trough-like structure 110 includes an opening 126 bounded by a first tubular portion 128 and located intermediately of the longitudinal extent of the front wall portion 100. A second tubular portion 130 of a diameter slightly smaller than that of the first tubular portion 128 is fixed within said first tubular portion 128. The second tubular portion 130 includes a peripheral barb 132 so that a suitable length of hose 134 may be engaged over the barb 132 and onto the second tubular portion 130. Crevice cleaners, dusting tools or other accessories may be detachably secured to said length of hose as required in particular cleaning applications.

Attachment of the hose assembly 98 to the nozzle 52 is as follows:

The base plate 68 of the nozzle 52 includes two forwardly disposed and spaced apart apertures 136, 138 and one spring loaded keeper or plunger 140 located centrally of the underside of the cleaner housing 142 and rearwardly of the base plate 68. The front wall portion 100 of the trough-like structure 110 includes two aligned and spaced apart hook-shaped projections 144 and 146 upstanding from the edge formation and complementary to the apertures 136 and 138 in the base plate such that when the hook-shaped projections 144 and 146 are brought into registration with the apertures 136 and 138 a swivelling relationship is established between such projections and such apertures such that the hose assembly 98 may be swivelled rearwardly over the base plate 68. Locating ribs 148, 150 extending upwardly from side wall portions 104 are adapted to engage the edges 152, 154 of the inlet orifices 80, 82 respectively so as to position the hose assembly for airtight sealing engagement over said inlet orifices when same is brought into overlying registration with the base plate 68. The back wall portion 102 of the trough-like structure 110 includes an arm 156 extending rearwardly and centrally of the back wall portion 102 of the trough-like structure 110, said arm being adapted to be brought into registration and to cooperate with the spring loaded keeper or plunger 140 when the hose assembly is swivelled onto the base plate so as to releasably secure same to said base plate.

What I claim is:

1. In vacuum cleaner apparatus wherein an endless tensioned belt is adapted to be applied over and extend between a rotary beater element and the unsupported end of a motor-driven shaft or removed therefrom, with said belt being twisted to present two spaced apart reaches thereof with a first loop engaging over said rotary beater element and a second loop engaging over said unsupported end of said motor driven shaft in a position disposed inwardly thereof when said belt is driven by said shaft and displaced outwardly thereof from the aforesaid position of said second loop to disengage therefrom when said shaft is driven by said belt through reverse rotation of said beater element, a housing therefore including an internal suction passageway therein extending from said rotary beater element to said unsupported shaft end and enclosing said endless tensioned belt therewithin, said housing having an opening thereinto providing access to said suction passageway and to said second loop of said belt for applying same over said unsupported shaft end or removing same therefrom, and a removable closure element for closing said access opening during normal operation to complete said suction passageway, a bearing surface formation fixedly carried by said removable closure element to project inwardly therefrom into said suction passageway when said access opening is closed thereby, said bearing surface formation having an extent and configuration so as to occupy a region within said suction passageway between said shaft and said rotary beater element and in spaced apart relation outwardly of the position of at least one of said reaches of said endless tensioned belt when driven by said shaft and to bear against said aforesaid reach of said belt only when displaced outwardly from said aforesaid position of said reach when said shaft is driven by said belt through reverse rotation of said beater element whereby further displacement from the position of engagement of said second loop applied over said unsupported end of said shaft is restrained.

2. Apparatus according to claim 1 wherein said bearing surface formation includes an anchoring portion carried by said removable closure element and a projecting portion extending therefrom into said passageway.

3. Apparatus according to claim 2 wherein said projecting portion comprises an elongated flange with the elongated edge thereof. remote from said anchoring portion constituting the bearing surface.

4. Apparatus according to claim 3 wherein said elongated edge is positioned at substantially right angles to the direction of travel of one of said reaches of said driven endless belt.

* * * * *